US011074772B2

(12) United States Patent
Gnanachandran et al.

(10) Patent No.: US 11,074,772 B2
(45) Date of Patent: Jul. 27, 2021

(54) WIRELESSLY-CONTROLLED FINGERPRINT LOCKING DEVICE AND METHOD OF USE

(71) Applicants: Janahan Gnanachandran, Arlington, TX (US); Janarthan Gnanachandran, Arlington, TX (US)

(72) Inventors: Janahan Gnanachandran, Arlington, TX (US); Janarthan Gnanachandran, Arlington, TX (US)

( * ) Notice: Subject to any disclaimer, the term of this patent is extended or adjusted under 35 U.S.C. 154(b) by 0 days.

(21) Appl. No.: 16/271,862

(22) Filed: Feb. 10, 2019

(65) Prior Publication Data

US 2019/0251769 A1 Aug. 15, 2019

Related U.S. Application Data

(60) Provisional application No. 62/628,987, filed on Feb. 10, 2018.

(51) Int. Cl.
*G07C 9/00* (2020.01)

(52) U.S. Cl.
CPC ..... *G07C 9/00563* (2013.01); *G07C 9/00182* (2013.01)

(58) Field of Classification Search
CPC ..... G07C 9/00563; G07C 9/00182; G07C 9/00158
See application file for complete search history.

(56) References Cited

U.S. PATENT DOCUMENTS 10,039,401 B1 * 8/2018 Romanucci ..... A47C 7/628
2004/0108938 A1 * 6/2004 Entrekin ..... G07C 9/00309 340/5.73
2010/0176919 A1 * 7/2010 Myers ..... G07C 9/00571 340/5.73
2016/0033966 A1 * 2/2016 Farris ..... A47G 29/141 701/15
2016/0053526 A1 * 2/2016 Dittrich ..... E05G 1/04 109/38
2016/0140496 A1 * 5/2016 Simms ..... B64C 39/024 705/337
2016/0148452 A1 * 5/2016 Torquemada Jimenez ..... B65D 33/25 206/1.5
2017/0046898 A1 * 2/2017 Cabouli ..... G07C 9/00563
2018/0215526 A1 * 8/2018 Hsu ..... G07C 9/00563

* cited by examiner

*Primary Examiner* — Thomas D Alunkal
(74) *Attorney, Agent, or Firm* — Leavitt Eldredge Law Firm

(57) ABSTRACT

A wirelessly-controlled fingerprint protected container containing a fingerprint scanner, a micro-computer, and a lock where the user can either unlock the device through the fingerprint scanner or platform (application) on the mobile device. The container can be shared with additional users by the owner sending an authorization code to another user via a smart device, and the second user can then wirelessly register his or her fingerprints and then unlock the container.

6 Claims, 5 Drawing Sheets

WIRELESSLY-CONTROLLED FINGERPRINT LOCKING DEVICE AND METHOD OF USE

BACKGROUND

1. Field of the Invention

The present invention relates generally to fingerprint protected containers, and more specifically, to a fingerprint protected and wirelessly-controlled locking container for safely storing or shipping materials, foods, beverages and other valuables. The invention of the present application further allows a user to be registered to have access to the container using a wireless connection and an authorization method from the container's owner and allow registered user(s) to access it using both fingerprints and a wireless device.

2. Description of Related Art

Fingerprint locking containers are well known in the art and are effective means to safely protect the contents of the container. For example, FIG. 1 depicts a conventional fingerprint locking system 101 having a container 103, a lock 105, a fingerprint scanner 107, and a handle 109. During use, the user locks the lock 105 thereby securing the contents of the container 103. When the user wants to unlock the container 103, the user places his or her finger on the fingerprint scanner 107, which reads the fingerprint, and unlocks the lock 105. The user then uses the handle 109 to open the container 103 and access the inside contents.

One of the problems commonly associated with device 101 is that other people the user wants to access the contents have no way to get around the fingerprint lock. For an example, a user could ship a material in a fingerprint-protected container to a second person, wherein the user uses the fingerprint lock to prevent anyone from accessing it while it is in transit. However, once the material reaches the destination, the receiver has no way to access the material since his or her fingerprints are not the same as the user's. Similarly, if the container needs to be shared among multiple people in a home, office, or an apartment, the container should be able to store multiple fingerprints.

Additionally, the conventional fingerprint locking devices are not wirelessly-enabled and also, they do not allow for wirelessly tracking of the container while it is in transit. Also, safes are generally made from heavy, bulky material and are not conducive for shipping or transit.

Accordingly, although great strides have been made in the area of fingerprint locking containers, many shortcomings remain.

DESCRIPTION OF THE DRAWINGS

The novel features believed characteristic of the embodiments of the present application are set forth in the appended claims. However, the embodiments themselves, as well as a preferred mode of use, and further objectives and advantages thereof, will best be understood by reference to the following detailed description when read in conjunction with the accompanying drawings, wherein:

Figure 1:
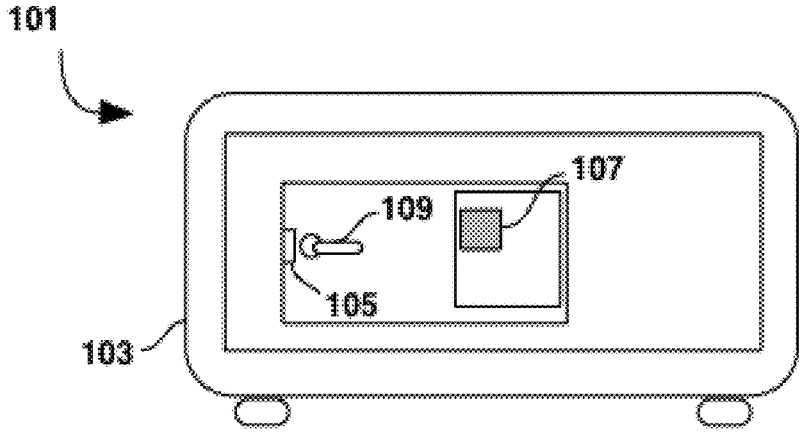
FIG. 1 Prior Art
FIG. 1 is a front view of a common fingerprint locking container.

While the system and method of use of the present application is susceptible to various modifications and alternative forms, specific embodiments thereof have been shown by way of example in the drawings and are herein described in detail. It should be understood, however, that the description herein of specific embodiments is not intended to limit the invention to the particular embodiment disclosed, but on the contrary, the intention is to cover all modifications, equivalents, and alternatives falling within the spirit and scope of the present application as defined by the appended claims.

DETAILED DESCRIPTION OF THE PREFERRED EMBODIMENT

Illustrative embodiments of the system and method of use of the present application are provided below. It will of course be appreciated that in the development of any actual embodiment, numerous implementation-specific decisions will be made to achieve the developer's specific goals, such as compliance with system-related and business-related constraints, which will vary from one implementation to another. Moreover, it will be appreciated that such a development effort might be complex and time-consuming, but would nevertheless be a routine undertaking for those of ordinary skill in the art having the benefit of this disclosure.

The system and method of use in accordance with the present application overcomes one or more of the above-discussed problems commonly associated with conventional fingerprint locking devices. Specifically, the invention allows for the owner of the container to send other users an authorization code to register and store their fingerprints in order to use and unlock the container. In addition, the wireless control allows a secondary unlock method and is also enabled to track the location of the container during shipping for more secure shipping. The invention may also be small enough that the container can be used to secure items in public, such as ensuring food is not tampered with in a school or workplace setting. These and other unique features of the system and method of use are discussed below and illustrated in the accompanying drawings.

The system and method of use will be understood, both as to its structure and operation, from the accompanying drawings, taken in conjunction with the accompanying description. Several embodiments of the system are presented herein. It should be understood that various components, parts, and features of the different embodiments may be combined together and/or interchanged with one another, all of which are within the scope of the present application, even though not all variations and particular embodiments are shown in the drawings. It should also be understood that the mixing and matching of features, elements, and/or functions between various embodiments is expressly contemplated herein so that one of ordinary skill in the art would appreciate from this disclosure that the features, elements, and/or functions of one embodiment may be incorporated into another embodiment as appropriate, unless described otherwise.

The preferred embodiment herein described is not intended to be exhaustive or to limit the invention to the precise form disclosed. It is chosen and described to explain the principles of the invention and its application and practical use to enable others skilled in the art to follow its teachings.

Figure 2:
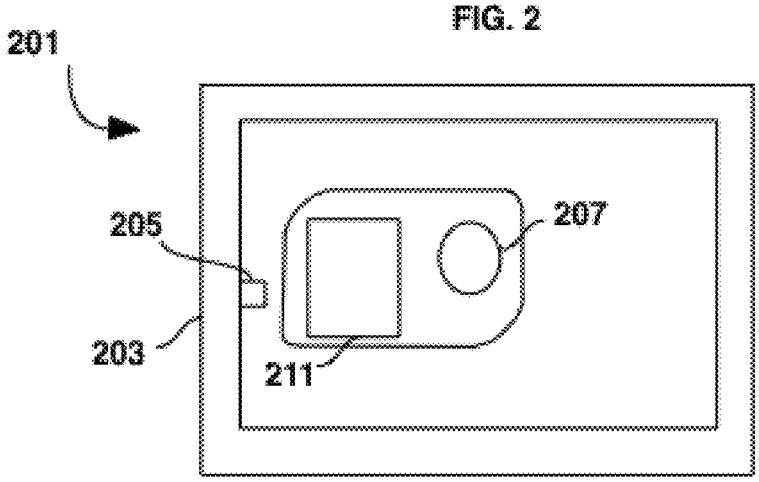
FIG. 2 is a front view of a wirelessly-controlled fingerprint locking container in accordance with a preferred embodiment of the present application.

Referring now to the drawings wherein like reference characters identify corresponding or similar elements throughout the several views, FIG. 2 depicts a front view of a wirelessly-enabled fingerprint locking device in accordance with a preferred embodiment of the present application. It will be appreciated that system 201 overcomes one or more of the above-listed problems commonly associated with conventional fingerprint locking devices.

In the contemplated embodiment, system 201 includes a container 203, a lock 205, a fingerprint scanner 207, and a wirelessly-controlled internal computing device 211, the internal computing device having a unique ID associated therewith and configured to provide a means to communicate wirelessly with other computing devices. During use, the lock 205 is configured to be locked to secure the contents of the container 203 from tampering or unwanted access.

In the preferred embodiment, the computing device 211 is configured to provide one or more means to unlock container 203. During initial set up of container 203, the user can register, scan and record their fingerprint within the computing device 211 using wireless computing device such as a mobile phone. In this embodiment, the user's fingerprint therefore provides a means of which to unlock container 203. In some embodiments, additional fingerprints can be stored, thereby being associated with other persons such as the owner's family. In this embodiment, the owner could send authorization codes to other user(s), and have them registered to the device. In this embodiment, multiple users can have access to the contents of container 203.

It is also contemplated that the internal computer can allow the user to wirelessly track the container 203 while it is in transit. It should be appreciated that the tracking and the collection of one or more fingerprints can be achieved via a platform, such as a mobile application, thereby allowing for the user to easily control and receive updates regarding the container. In this embodiment, the user can use the platform to transmit permission to a second user to access container 203, wherein the user indicates that the second user's fingerprint (as read and determined by a second mobile device) is to be granted access to container 203.

It is contemplated that the container can include necessary features, such as a power source, to achieve the functionality discussed herein.

It should be appreciated that one of the unique features believed characteristic of the present application is that a first user can share access to the container by granting access through a platform to a second user, the granted access being assigned to the second user's fingerprint. It is contemplated that the invention can be used to prevent tampering of food in other settings outside of shipping, such as if the user has a food allergy and needs to ensure his or her food container is not opened. For example, if a user has a peanut allergy and needs to ensure his or her food container is not accidentally opened exposing it to peanuts, he or she could use the device to make sure no one else is able to open the container 203 through the fingerprint scanner 207.

It is contemplated that the material of the container 203, in the preferred embodiment, is comprised of a lightweight material such as plastic, as to be easier and cheaper to ship or carry during everyday activities, or a thermal material to insulate food or other perishable items. It should be appreciated that container 203 is not designed to be composed of a heavy, impenetrable material, such as conventional safes are, thereby making container 203 more economical to produce as well as lightweight for travel.

Another unique feature believed characteristic of the present application is the internal computing device allows the user to wirelessly track the container 203. For example, if the user is shipping an item that he or she wants to make sure reaches its destination and that no one else has tampered with it, the user could lock the container 203 with the fingerprint lock, track the container 203 while it is transit, and then grant access to a second user via the platform.

It should be appreciated that in some embodiments, lock 205 can further be unlocked via a wireless device application, wherein a digital code is configured to be transmitted between one or more mobile devices and the computer 211, the digital code providing a key to communicate with the internal computing device of the computer.

Figure 3:
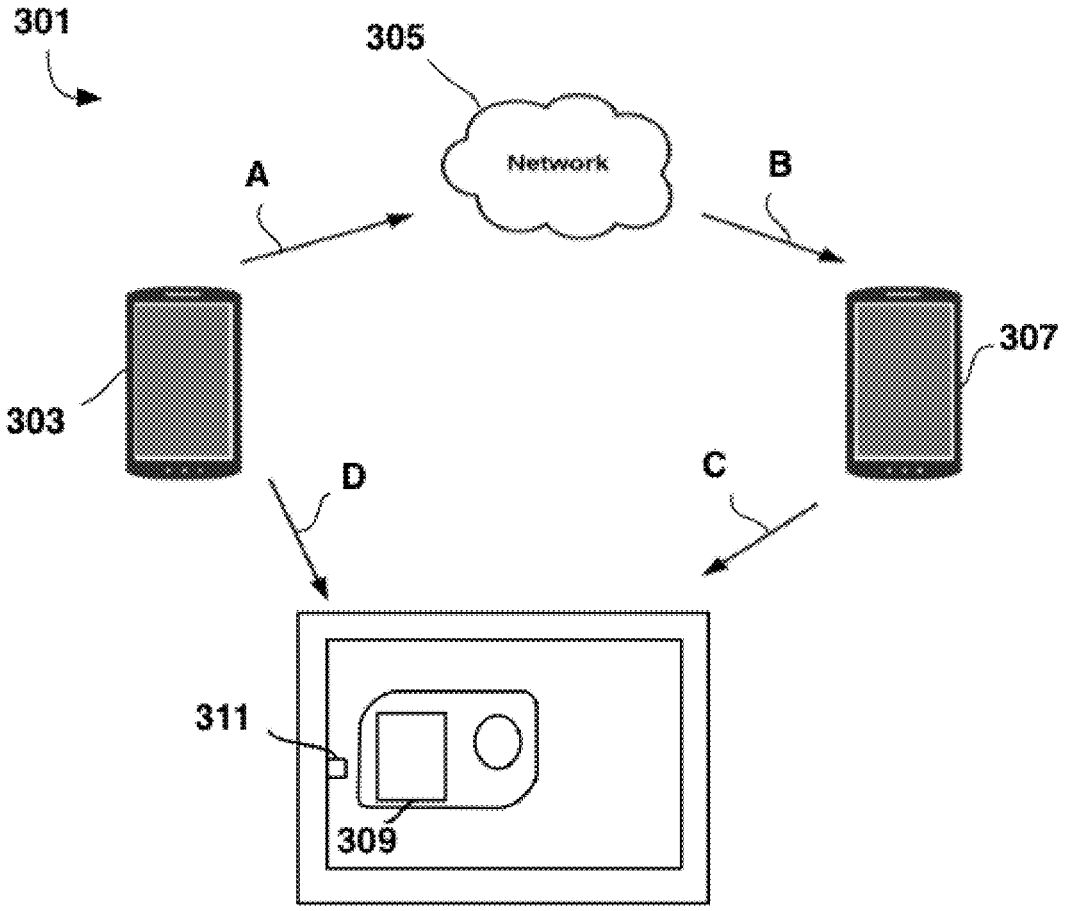
FIG. 3 is a simplified schematic depicting the wirelessly-enabled fingerprint locking container communicated with a network and a mobile device.

FIG. 3 is a simplified schematic depicting how the container can connect and interact with one or more smart phones, or other computing devices. The first user can lock and unlock the container via a digital code transmitted wirelessly between the first computing device 303 and the internal computer of the container, as shown with arrow D. Alternatively, the first user can transmit the digital code or grant access via fingerprint recognition, to a second user, as shown with arrow's A and B, wherein the second user can then either digitally communicate with the internal computing device to unlock the container or use their fingerprint, as shown with arrow C. It should be appreciated that the use of the digital code can be translated in any known or future means, such as Bluetooth technology, cellular technology, and the like.

An additional contemplated feature of the container is contemplated where the user can use the smart device 303 to connect to the network 305 and track the device through the device's internal computer, the internal computer having a geospatial tracking system incorporated therein.

Figure 4:
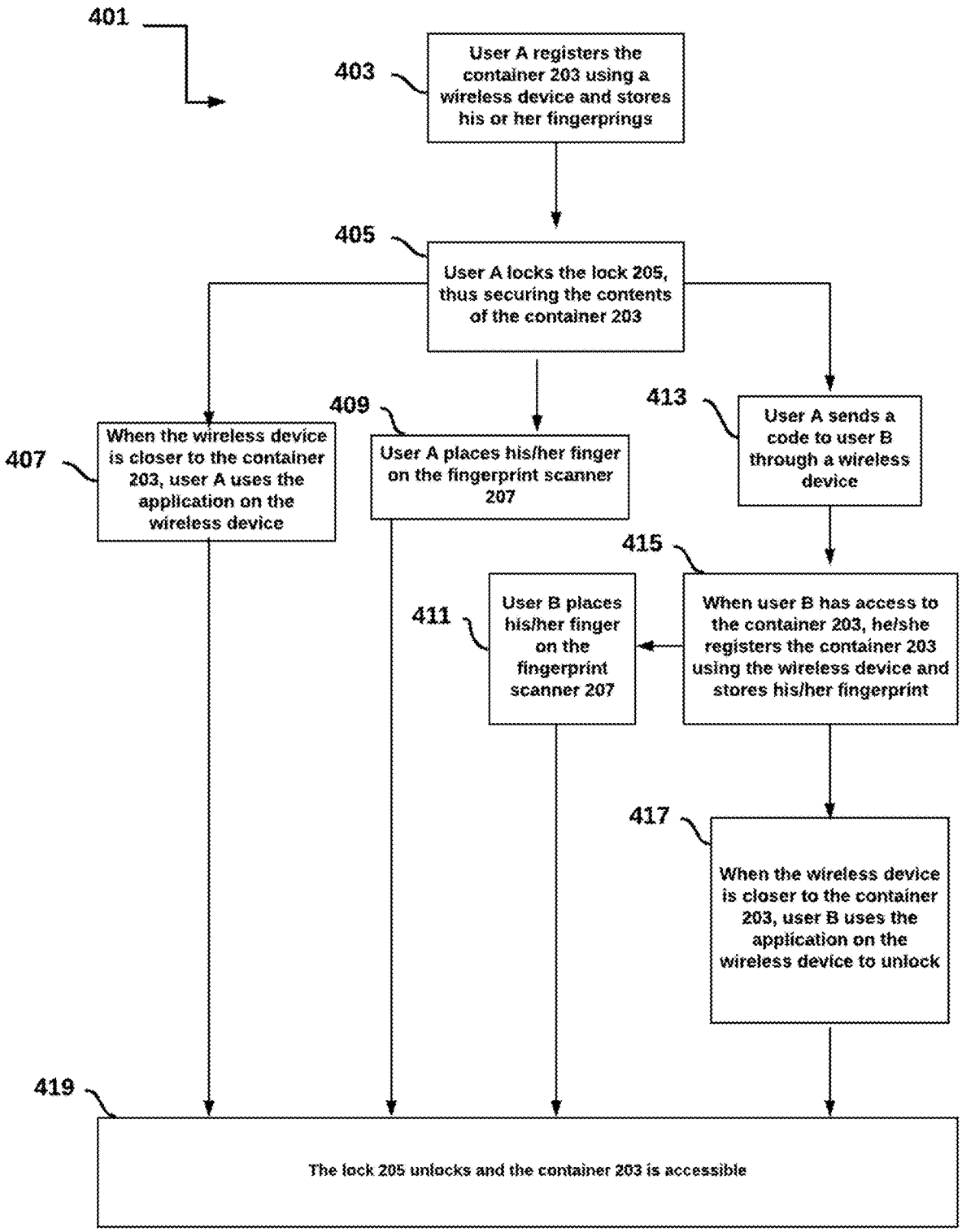
FIG. 4 is a flowchart depicting the preferred method of use.

FIG. 4 is a flowchart depicting the preferred methods of use. The first user "A" registers the container 203 using a wireless device and stores his or her fingerprints, as shown in box 403. It should be appreciated that registration involves associating the unique ID of the container to User A. User A then locks the lock 205 and secures the contents of the container 203, as shown in box 405. To unlock the container, the user A has two options. User A could either use fingerprint to unlock the container 203, as shown in 409 and 419 or when user A's wireless device is close to the container 203, he or she can use the platform (application) on the mobile device to unlock the container, as shown in boxes 407 and 419. In order to share the container, user A can send a code to user B through a wireless device, as shown in box 413. When user B has access to the container 203, he or she can register the container 203 using the wireless device and store his or her fingerprint as shown in box 415. User B then places his or her finger on the fingerprint scanner and unlocks the container 203, as shown in boxes 411 and 419. User B can also use his or her the platform (application) on the mobile device to unlock the container, as shown in boxes 417 and 419.

Figure 5:
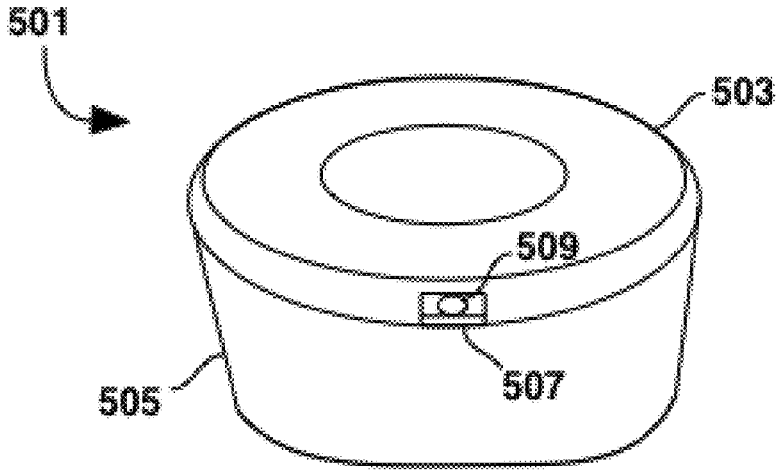
FIG. 5 is a front view of an alternative embodiment of a wirelessly enabled fingerprint locking device in accordance with the present application.

In FIG. 5 an alternative embodiment of a container 501 of the present invention is shown, being similar in form to system 201. In this embodiment, a removable lid 503 is secured to the container's body 505 through a lock 507. The lock is unlocked through a fingerprint scanner 509, located on the removable lid 503 or via wireless communication between a computing device and an internal computing device (not shown) of container 501. During use, the user locks the lock 507 thereby securing the removable lid 503 to the container's body 505. When the user wants to unlock the device, he or she scans his or her fingerprint on the fingerprint scanner 509, which unlocks the lock 507 and allows the removable lid 503 to be removed from the container's body 505.

It is contemplated that the container's body 505 is comprised of a food-safe material such as glass, plastic, or the like, that can be safely stored in a refrigerator. It is contemplated that the lid 503 is comprised of a food-safe material such as plastic.

The particular embodiments disclosed above are illustrative only, as the embodiments may be modified and practiced in different but equivalent manners apparent to those skilled in the art having the benefit of the teachings herein. It is therefore evident that the particular embodiments disclosed above may be altered or modified, and all such variations are considered within the scope and spirit of the application. Accordingly, the protection sought herein is as set forth in the description. Although the present embodiments are shown above, they are not limited to just these embodiments, but are amenable to various changes and modifications without departing from the spirit thereof.

What is claimed:

1. A wirelessly-controlled fingerprint locking system, comprising:

a container having a lid secured to a body;

an electronic lock configured to lock the lid to the body, the electronic lock having:

a fingerprint scanner; and a computing device configured to wirelessly communicate with one or more computing devices, the computing device having:

a geospatial tracking system to provide a location of the container to the one or more computing devices;

a first mobile computing device having a first platform configured to allow a first user to grant access to a second user;

a second mobile computing device wirelessly connected to the first mobile device and the electronic lock, the second mobile computing device having a second platform;

the first platform allows the first user to invite the second user to register with the computing device of the container;

the second platform registering the second user with the computing device of the container such that the registration allows for the second user to unlock the electronic lock through one of a proximity to the computing device as determined by the geospatial tracking system or a second user fingerprint;

wherein the electronic lock is configured to be unlocked via one or more fingerprints; and wherein the electronic lock is configured to unlock via the first mobile device and the second mobile device as the first mobile device and the second mobile device is within a predetermined proximity to the container.

2. The device in claim 1, wherein the container is comprised of plastic.

3. A method of unlocking a box, the method comprising the locking system of claim 1;

transmitting the geolocation of the second device to the first mobile device via the geospatial tracking system; and locking the electronic lock to secure one or more items within the container.

4. The method of claim 3, further comprising:

placing a finger on the fingerprint scanner, thereby unlocking the electronic lock.

5. The method of claim 3, further comprising:

sending a digital code to the computing device via one of the one or more second computing devices;

wherein the digital code unlocks the container.

6. The method of claim 3, further comprising:

sending a digital code to a second user via the one or more second computing devices;

wherein the digital code is configured to be wirelessly transmitted to the electronic lock to unlock the electronic lock.

* * * * *